United States Patent [19]

Hebert et al.

[11] 4,163,455

[45] Aug. 7, 1979

[54] CLEANING APPARATUS FOR SHIP HOLDS

[76] Inventors: Chris J. Hebert; Ralph T. Hollister, both of 157 N. Leo, Baton Rouge, La. 70806

[21] Appl. No.: 851,342

[22] Filed: Nov. 14, 1977

[51] Int. Cl.[2] ..... B63B 59/00

[52] U.S. Cl. ..... 134/167 R; 134/172; 114/222

[58] Field of Search ..... 114/222, 270; 134/167 R, 168 R, 172, 22 R

[56] References Cited

U.S. PATENT DOCUMENTS

| | | | |
|---|---|---|---|
| 3,593,728 | 7/1971 | Sauer | 134/168 R |
| 3,688,782 | 9/1972 | Smith | 134/167 R |
| 3,696,825 | 10/1972 | Guignon | 134/167 R |
| 3,864,876 | 2/1975 | Diehn | 114/222 |
| 3,884,153 | 5/1975 | Sugimoto | 105/29 R |

*Primary Examiner*—Trygve M. Blix
*Assistant Examiner*—D. W. Keen
*Attorney, Agent, or Firm*—Roy, Kiesel, Patterson & Abadie

[57] ABSTRACT

An apparatus for cleaning cargo or tanker holds of ships is provided having a central support axle extending from the hold floor to the ship deck and on which is a trolley assembly having adjustable spray nozzles which trolley can travel vertically, as well as, rotationally about the support axle.

7 Claims, 7 Drawing Figures

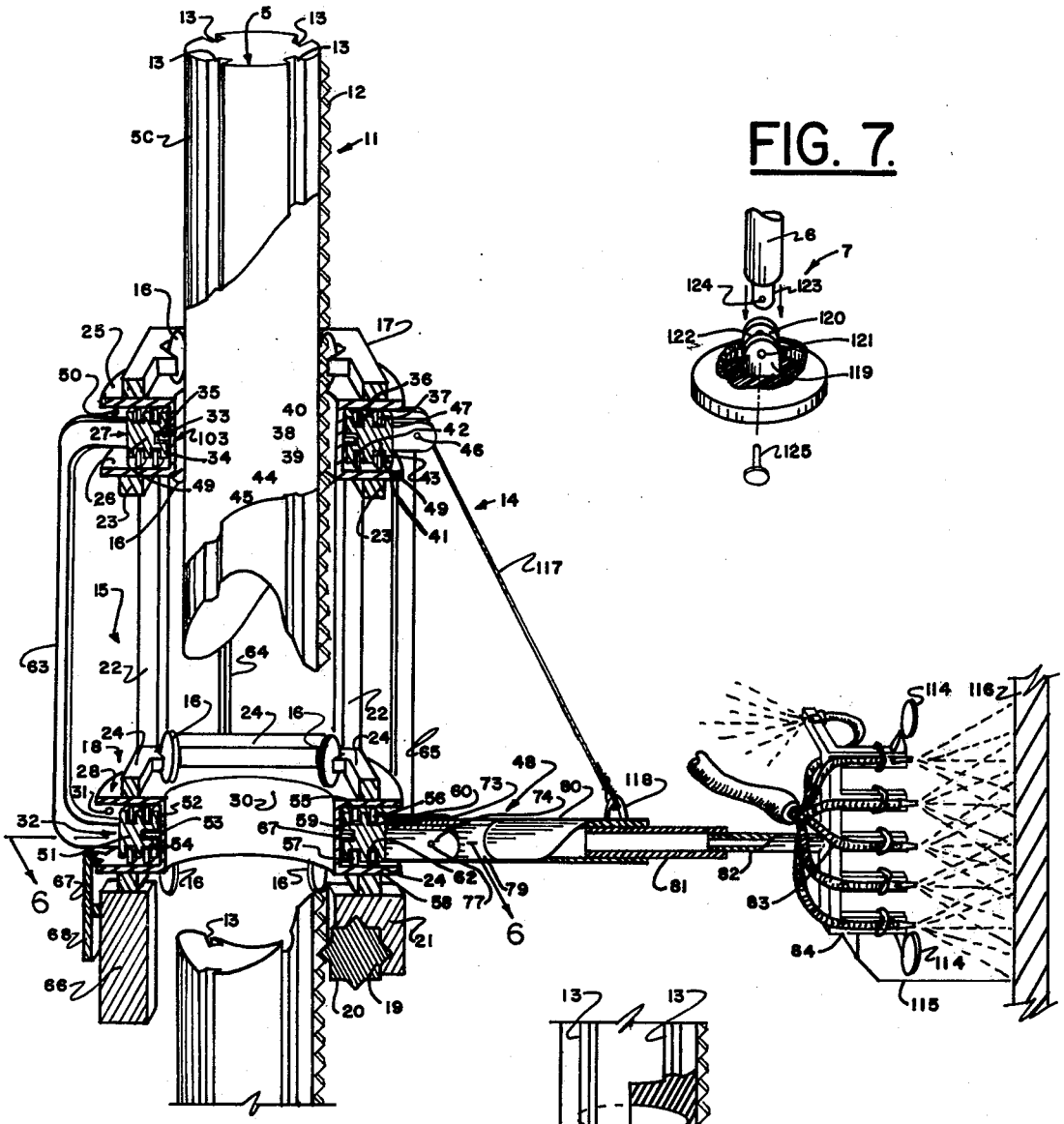
FIG. 3.
FIG. 7.
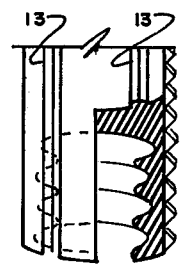
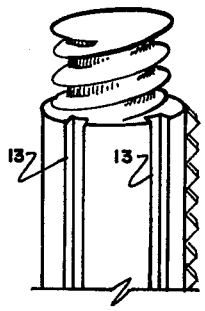
FIG. 4.

CLEANING APPARATUS FOR SHIP HOLDS

BACKGROUND OF THE INVENTION

1. Field of the Invention

This invention relates to apparatus for cleaning ship holds.

2. Prior Art

The cleaning of ocean going vessels has always presented major and expensive problems for the owners. These problems have been particularly acute when cleaning cargo or tanker holds. One of the major problems is the residue left by corrosive or highly flammable materials. Since the next cargo to be carried is generally different, it is imperative that the residue be removed so as not to contaminate or react with the new cargo. A second major problem incurred is the large amount of scale and rust formed when handling certain corrosives.

The present method utilized by the ship cleaning industry is to station men inside the holds equipped with very high pressure water hoses to literally knock down and remove the scale and rust. Unfortunately, this practice is highly dangerous as the water jet used can tear a man apart. Another major problem is that these practices are not as efficient or as fast as is desired. Still another problem is the removal of scale and rust from behind beams or in upper corner areas of the ship's hold which the men on the floor cannot see or the water jet cannot reach with sufficient force.

SUMMARY OF THE INVENTION

Therefore, one object of this invention is to provide an apparatus for cleaning a ship's hold in an efficient, fast and safe manner.

Another object of this invention is to provide an apparatus for cleaning all areas of a ship's hold.

These and other objects and advantages of this invention will become apparent from the ensuing descriptions of the invention.

Accordingly, an apparatus for cleaning a ship's hold is provided having a central support axle vertically positionable in the hold, a first securing means attached to the axle and attachable to the hold floor for fixedly holding the axle to the floor, a second securing means attached to the axle and attachable to the ship's deck for fixedly holding the axle vertically in the hold, a trolley carriage attachable to the axle for vertical travel up and down the axle, and a nozzle positioning assembly rotatably attached to the carriage, the assembly having an extendable arm to which are attached water nozzles for spraying water from a water source.

BRIEF DESCRIPTION OF THE DRAWINGS

FIG. 3 is a cutaway view taken along lines 3—3 of FIG. 2 illustrating a preferred embodiment of the trolley carriage and nozzle positioning assembly.

FIG. 4 is a perspective view of a preferred embodiment of the central support axle.

FIG. 7 is a perspective, cutaway view of a preferred embodiment of the electromagnet anchoring the bottom of the vertical axle to the ship's floor.

PREFERRED EMBODIMENTS OF THE INVENTION

Figure 1:
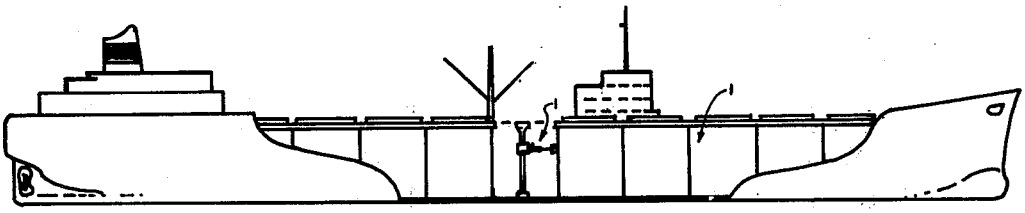
FIG. 1 is a cutaway perspective view of the cleaning apparatus in position for use in a typical ship hold.

A typical ocean going tanker as shown in FIG. 1 will have as many as ten or more holds, denoted generally by the numeral 1. Although each hold 1 may be of different dimensions, a conventional tanker hold may be as much as 80 feet deep, 40 feet wide and 20 feet long. Examining FIG. 2, such a hold is illustrated with many of the structural cross-members left out for simplicity reasons. Within hold 1, the cleaning apparatus, denoted generally by the numeral 2, is positioned vertically in the center area of the hold. On the ship's deck 3, the water pumps and other peripheral equipment can be located in a storage shed 4.

Cleaning apparatus 2 has a central axle 5 that extends vertically into the hold. To rigidly fix axle 5 in hold 1, one end 6 is connected to a securing means, such as electromagnet 7 and the other end 8 is connected to bracing means, such as collar 9 and extension arm clamps 10. Axle 5 is provided with track 11, which is preferably a metal bar having a straight row of gear teeth 12 extending from the top of axle 5 to the bottom. In addition, it is preferred that axle 5 have parallel guide grooves 13 also running from the top to the bottom of axle 5. In still another preferred feature, axle 5 will be constructed in sections 5A, 5B, 5C and 5D, which screw together as shown in FIG. 4. This feature facilitates the storage, transportation and assembly of axle 5, as well as, allows the use of the same axle section for different holds which may vary from 20 to 80 feet in depth.

Figure 2:
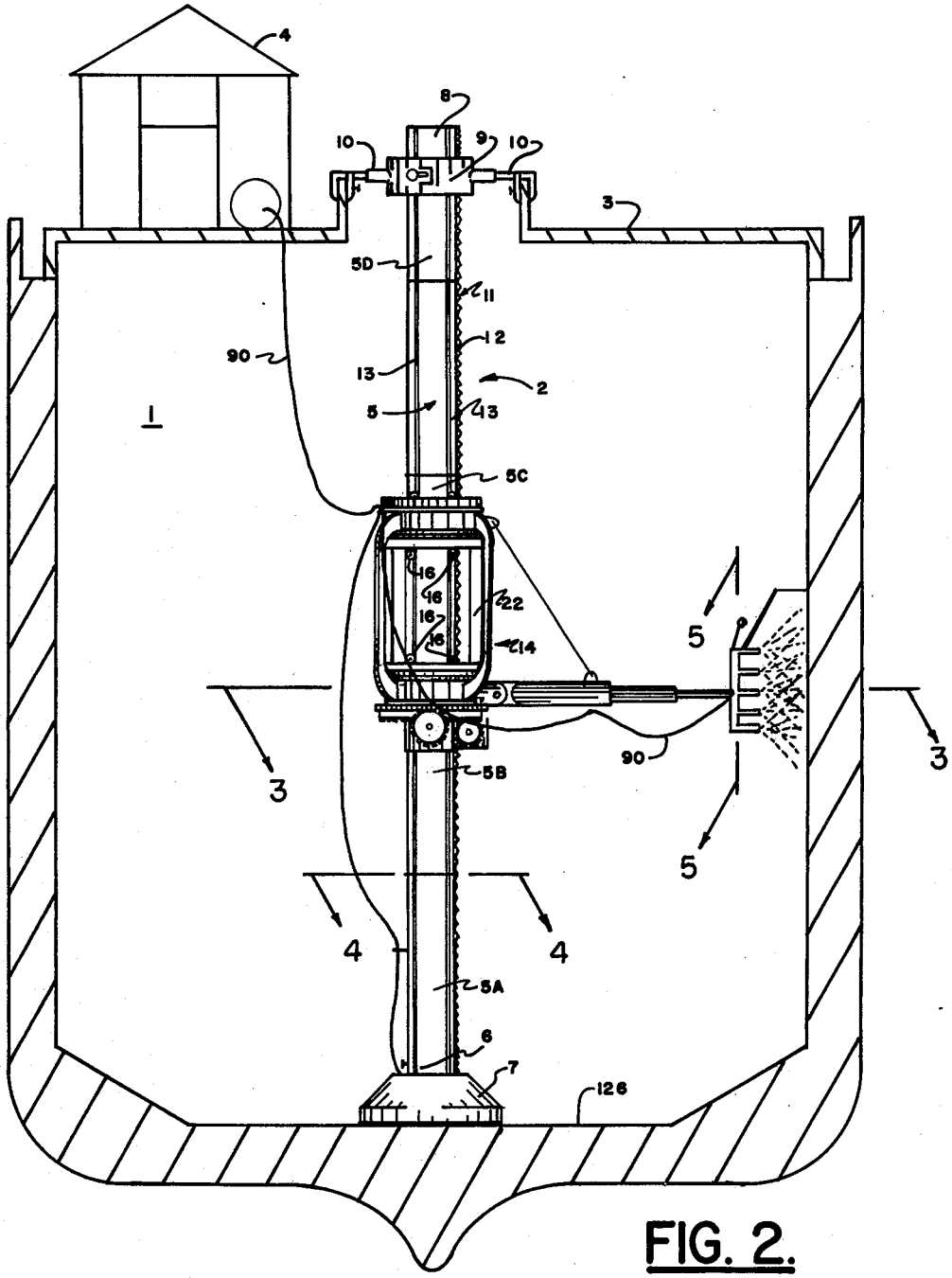
FIG. 2 is a perspective view illustrating a preferred embodiment of the cleaning apparatus positioned within a typical tanker hold.

Mounted on axle 5 is trolley carriage 14 which broadly comprises a frame assembly 15 to which guide wheels 16 are rotatably mounted to fit in guide grooves 13, nozzle positioning assembly mounting braces 17 and 18 attached to frame assembly 15, and a mating gear wheel 19 having teeth 20 which mesh with teeth 12 of track 11. Mating gear wheel 19 is connected to a drive motor 21 also mounted on lower brace 18. In a preferred embodiment, frame assembly 15 is constructed of vertical steel members 22, upper horizontal steel members 23 and lower horizontal steel members 24, which are welded together to form a box structure about axle 5 as shown in FIGS. 2 and 3. Guide wheels 16 are then rotatably mounted in each interior corner of the box structure as shown in FIG. 3. On top of upper steel members 23 is upper nozzle positioning assembly mounting brace 17, which is constructed from circular metal piece 103, which forms a ring about axle 5 and upper and lower circular metal strips 25 and 26 are welded to piece 103 to form a ring cavity 50 into which is fitted upper collar assembly 27. In similar fashion, lower brace 18 is constructed from circular metal strips 28, 29 and piece 30 welded together to form a ring cavity 31 into which is fitted lower collar assembly 32.

In a preferred embodiment, circular metal piece 103 is provided with a metal ridge piece 33 which serves as a stabilizing guide for the upper collar assembly 27 as described below. Assembly 27 is constructed from a circular metal block 49 that extends completely around and adjacent circular metal piece 103. In surface 34 is a groove 35 into which metal ridge piece 33 fits. Assembly 27 is also provided with conventional bearing rings 36, 37, which fit into slots 38, 39, respectively, located on top surface 40 of assembly 27. In similar fashion, bottom 41 of assembly 27 is provided with slots 42, 43 into which fit conventional bearing rings 44, 45, respectively. Assembly 27 is sized so that the bearing in bearing rings 36, 37, 44 and 45 are adjacent the corresponding metal strips 25, 26 to allow assembly 27 to rotate easily in ring cavity 50. In another preferred embodiment, pulley 46 is attached to outer assembly surface 47 to vertically lift nozzle positioning assembly 48 as more fully described hereinbelow.

Lower collar assembly 32 is also constructed from a circular metal block 51 that extends completely around and adjacent circular metal piece 30. In a preferred embodiment, block surface 52 is provided with groove 53 into which metal ridge piece 54 fits. As in assembly 27, conventional bearing rings 55, 56, 57 and 58 are fitted in slots 59, 60, 61 and 62, respectively, to facilitate the revolving of assembly 32 in cavity 31.

Figure 6:
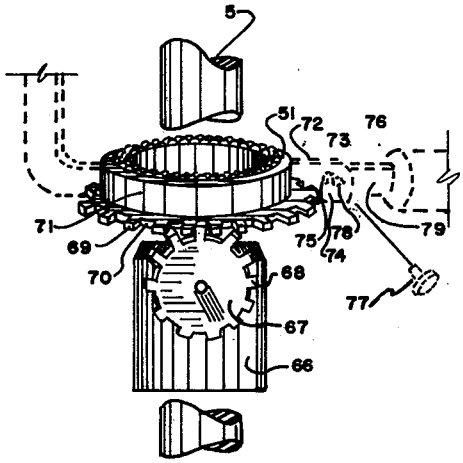
FIG. 6 is a preferred view of the rotational gears of the nozzle positioning assembly taken along lines 6—6 of FIG. 3.

Assemblies 27 and 32 are fixedly connected to one another by metal brace arms 63, 64 and 65 so that both assemblies rotate in unison when motor 66 drives gear 67 that has gear teeth 68 mating with gear teeth 69 of gear 70 fixedly mounted on block 51 as shown in FIG. 6.

Figure 5:
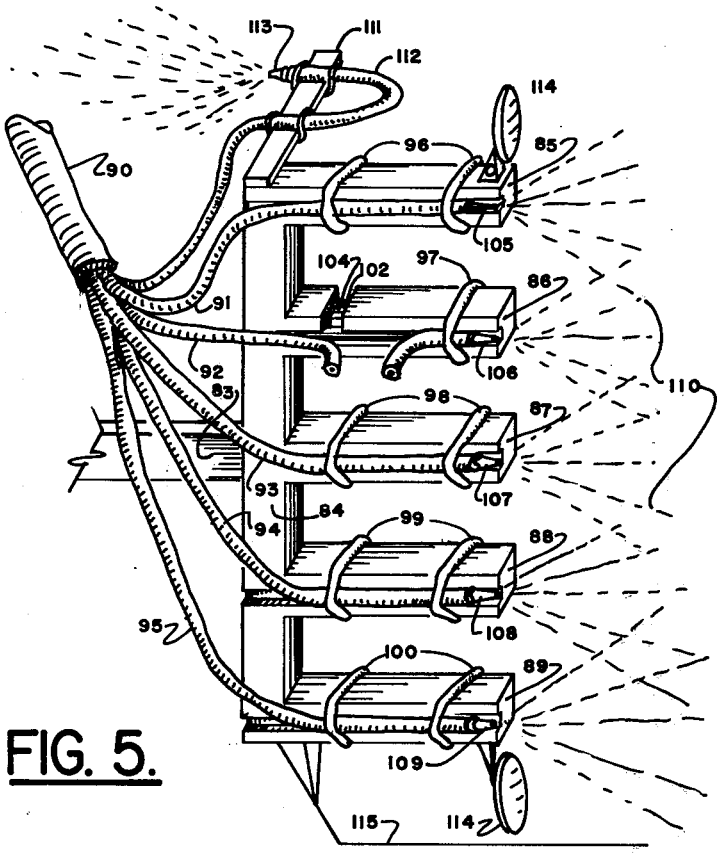
FIG. 5 is a perspective view of a preferred embodiment of the nozzle positioning carriage.

Pivotedly extending from lower block surface 71 is nozzle positioning assembly 48. More particularly, pivot mount 72 extends perpendicularly from block surface 72 and is provided with parallel separated shoulder sections 73 and 74 having aligned openings 75, 76, respectively, for receiving pivot bolt 77 which passes through openings 75, 76 and through opening 78 of tongue member 79 located between shoulder sections 73 and 74 as shown. Attached to tongue member 79 is arm assembly 80 having telescoping members 81 and 82 that can be extended further from or contracted toward block surface 71 by conventional hydraulic means. Attached to the end 83 of member 82 is hose support hand 84 having extending finger members 85, 86, 87, 88 and 89 as seen in FIG. 5. Extending from storage shed 4 is water hose bundle 90 containing hoses 91, 92, 93, 94 and 95, which are securely mounted on finger members 85, 86, 87, 88 and 89, respectively, by securing clamps 96, 97, 98, 99 and 100, respectively. Because of the extremely high water pressure (as much as 10,000 psi per hose), it is preferred that each finger be provided with grooves 101 into which each hose fits so as to increase the gripping surface of the clamps. It is further preferred that each finger member be provided with grooves 102 perpendicular to grooves 101 and into which the clamps fit. It is still further preferred that grooves 102 have champered edges 104. Each of hoses 91–95 are positioned with their respective nozzles 105, 106, 107, 108 and 109 directed to spray water 110 away from the cleaning apparatus. Preferably, finger 85 has attached thereto brace 111 to which can be attached hose 112 that has nozzle 113 directed back toward the cleaning apparatus to clean the back side of various structural braces found in the hold.

Other features which can be included are search lights 114 and sensing rods 115 attached to fingers 85 and 89 to help the operators determine the exact location of the hull side walls 116. Also, pulley 46 has cable 117 attached to ring 118 of arm assembly 80 to lower or raise the position of fingers 85–89 as may be needed. In another feature, electromagnet 7 is provided with parallel, separated shoulder sections 119 and 120 having aligned bolt openings 121, 122, respectively. In this configuration, axle end 6 is provided with tongue 123 with opening 124 that fits between shoulder sections 119 and 120 wherein openings 121, 122 and 124 are aligned to receive pivot bolt 125. In this manner, it will not matter if hold floor 126 is level or not in order to insure that axle 5 can be vertically positioned.

In operation, electromagnet 7 is positioned on hold floor 126 and axle section 5A is attached thereto. Next, the remaining axle sections 5B, 5C and 5D are assembled together and trolley carriage 14 is mounted thereon with fingers 85–89 pulled close to axle 5. Finally, axle 5 is securely fixed by attaching clamps 10. Trolley carriage 14 is lowered into position by activating motor 21, fingers 85–89 are lowered and extended into the desired position by pulley 46 and the hydraulic means in arm assembly 80. Water is then pumped through hoses 91–95 and the fingers rotated about axle 5 by activation of motor 66. This process is continued until the hold is cleaned.

There are, of course, many alternate embodiments not shown but which are meant to be included within the scope of the invention as defined in the following claims.

What I claim is:

1. An apparatus for cleaning a ship hold formed by a floor, side walls and ship deck having a hatch opening, which comprises:

(a) a central support axle vertically positionable within said hold, said central support axle comprising a metal strip having gear teeth extending into a straight line down said axle;

(b) a first securing means attached to said axle and attachable to said floor for fixedly holding said axle to said floor;

(c) a second securing means attached to said axle and attachable to said ship deck for fixedly holding said axle vertically;

(d) a trolley carriage attached to said axle for vertical travel up and down said axle, said trolley carriage comprising a drive means to which is attached a gear wheel having gear teeth mating with said metal strip gear teeth, a mounting brace extending around said axle forming a cavity opening away from said axle and wherein said nozzle positioning assembly comprises a circular metal block fitting into said cavity, bearing collars attached to said block and in contact with said mounting brace, a gear wheel having gear wheel teeth extending out of said cavity is attached to said block and a drive means, having a drive means gear with teeth mating with said gear wheel teeth attached to said mounting brace; and (e) a nozzle positioning assembly rotatably attached to said trolley carriage, said nozzle assembly having an extendable arm to which are attached water nozzles for spraying water.

2. An apparatus according to claim 1 wherein said nozzle positioning assembly comprises a nozzle support assembly having extendable members with nozzle support fingers attached to said members to which are attached water spray nozzles.

3. An apparatus according to claim 2 wherein said support fingers each have a first finger groove being parallel with said finger's length and into which said water spray nozzles partially fit.

4. An apparatus according to claim 1 wherein a stabilizing guide is attached to said mounting brace and extending into said cavity and fitting into a groove of said metal block fitting of said nozzle positioning assembly.

5. An apparatus for cleaning a ship hold formed by a floor, side walls and ship deck having a hatch opening, which comprises:

(a) a central support axle vertically positionable within said hold, said central support axle comprising a metal strip having gear teeth extending in a straight line down said axle;

(b) a first securing means attached to said axle and attachable to said floor for fixedly holding said axle to said floor;

(c) a second securing means attached to said axle and attachable to said ship deck for fixedly holding said axle vertically;

(d) a trolley carriage attached to said axle for vertical travel up and down said axle, said trolley carriage comprising a drive means to which is attached a gear wheel having gear teeth mating with said metal strip gear teeth, an upper mounting brace and lower mounting brace attached to one another, each brace extending around said axle forming a cavity opening away from said axle;

(e) a nozzle positioning assembly rotatably attached to said trolley carriage, said nozzle assembly having an extendable arm to which are attached water nozzles for spraying water and comprising an upper metal block and lower metal block fit into said upper mounting brace cavity and said lower mounting brace cavity, respectively;

(f) a second gear wheel having gear wheel teeth extending out of said lower mounting brace cavity attachable to said lower block; and (g) a drive means having a drive means gear with teeth mating with said gear wheel teeth is attached to said lower mounting brace.

6. An apparatus according to claim 5 wherein said support fingers each have a second finger groove perpendicular to said first finger groove and wherein an adjustable strip is fitted into said second finger groove to secure said water spray nozzle.

7. An apparatus according to claim 6 wherein said second finger grooves have champered edges at the position where it crosses said first finger groove.

* * * * *